United States Patent [19]

Hiroki et al.

[11] Patent Number: 4,570,909

[45] Date of Patent: Feb. 18, 1986

[54] LINING APPARATUS PROVIDED WITH A FOLDABLE SPRAY PIPE

[75] Inventors: Nobuyoshi Hiroki; Hiroyuki Ikemiya; Ryo Michioka; Tsutomu Ueno, all of Ibaraki; Yasuo Kishimoto, Kitakyushu; Yosisuke Nagano, Nakama, all of Japan

[73] Assignees: Sumitomo Metal Industries, Ltd., Osaka; Kurosaki Refractories Co., Ltd., Fukuoka, both of Japan

[21] Appl. No.: 633,950

[22] Filed: Jul. 24, 1984

[30] Foreign Application Priority Data

Oct. 13, 1983 [JP] Japan ..... 58-158431

[51] Int. Cl.[4] ..... C21B 7/04

[52] U.S. Cl. ..... 266/281; 266/271

[58] Field of Search ..... 266/280–287, 266/271, 44, 45; 264/30

[56] References Cited

U.S. PATENT DOCUMENTS 4,253,646 3/1981 Goto et al. ..... 266/281

FOREIGN PATENT DOCUMENTS 2825676 12/1978 Fed. Rep. of Germany ..... 264/30

2124519 2/1984 United Kingdom ..... 264/30

*Primary Examiner*—L. Dewayne Rutledge

*Assistant Examiner*—S. Kastler

*Attorney, Agent, or Firm*—James J. Ralabate

[57] ABSTRACT

A lining apparatus provided with a foldable spray pipe comprising an elevatable vertical support strut supported by a frame, a bifurcated support strut having the upper end thereof connected to the lower end of the elevatable vertical support strut, the bifurcated strut comprising a pair of parallely extending strut elements which define an arm storing space therebetween opening at both sides, a pipe supporting arm foldably connected to the lower end of the bifurcated strut and encasing a spray pipe therein and a protective path formed in each strut element of the bifurcated strut allowing a plurality of lines including a material supply line to pass therethrough.

3 Claims, 12 Drawing Figures

LINING APPARATUS PROVIDED WITH A FOLDABLE SPRAY PIPE

BACKGROUND OF INVENTION

The present invention relates to a lining apparatus for various metallurgical vessels including a torpedo car which has a small and squeezed mouth, but a wide inner space.

Conventionally, various apparatuses for the purpose of carrying on the above lining operation have been proposed. Japanese utility model publication No. 57-46055 discloses one such apparatus characterized by having a nozzle support tube made of first, second, and third tube elements which are pivotally connected to be foldable to each other and a spray nozzle rotatably connected to the first tube element. Due to such construction, the spray nozzle can be extended deeply in a torpedo car and can conduct a desired lining operation.

In general, although such a lining operation is carried out under high temperature and exposes the above support tube and the spray nozzle to such high temperature, the above mentioned lining apparatus is not provided with any means for protecting itself from the high temperature so that the device is less than optimal. Furthermore, in an operation to insert the support tube into the torpedo car through the mouth, all the tube elements consisting of first, second, and third tube elements must be aligned straight in series so that the entire apparatus becomes extremely tall and the construction thereof becomes expensive.

Japanese patent laid-open publication No. 54-77651 discloses another lining apparatus for the same purpose comprising a main strut, a frame for supporting the main strut, and a spray pipe pivotally connected to the extremity of the main strut and rotatable to a desired angle relative to the main strut. This apparatus can conduct a lining operation deeply in a torpedo car as in the case of the previously-mentioned apparatus of Japanese utility model publication No. 57-46055. However, this apparatus is also not provided with a means to sufficiently cope with the heat problem. That is, although the main strut is water-cooled, important lines including a material supply hose for supplying the spray material to the spray pipe and other control lines are subjected to the high temperature. The means for protecting the apparatus from the dust produced in the working site is also insufficient.

Accordingly, the object of the present invention is to provide a lining apparatus which can resolve the above-mentioned defects and can efficiently conduct the lining operation of a torpedo car while also sufficiently protecting itself from high temperature and dust.

The present invention, in summary, discloses a lining apparatus provided with a foldable spray pipe comprising an elevatable vertical support strut supported by a frame, a bifurcated support strut having the upper end thereof connected to the lower end of the elevatable vertical support strut, the bifurcated strut comprising a pair of parallely extending strut elements which define an arm storing space therebetween which opens at both sides, a pipe supporting arm foldably connected to the lower end of said bifurcated strut and encasing a spray pipe therein and a protective path formed in each strut element of the bifurcated strut allowing a plurality of lines including a material supply line to pass therethrough.

DETAILED DESCRIPTION OF DISCLOSURE

The present invention is hereinafter explained in view of an embodiment shown in the attached drawings.

Figure 1:
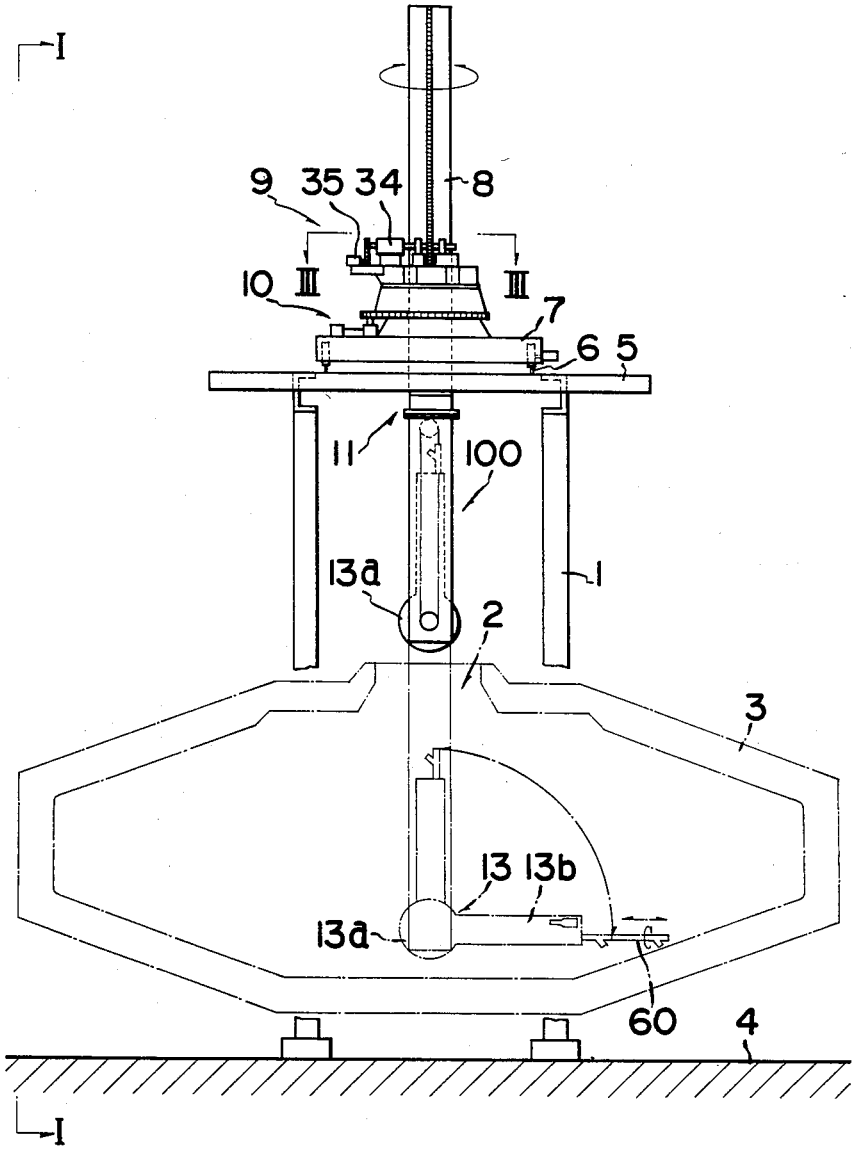
FIG. 1 is a front view of the lining apparatus of the present invention.
Figure 2:
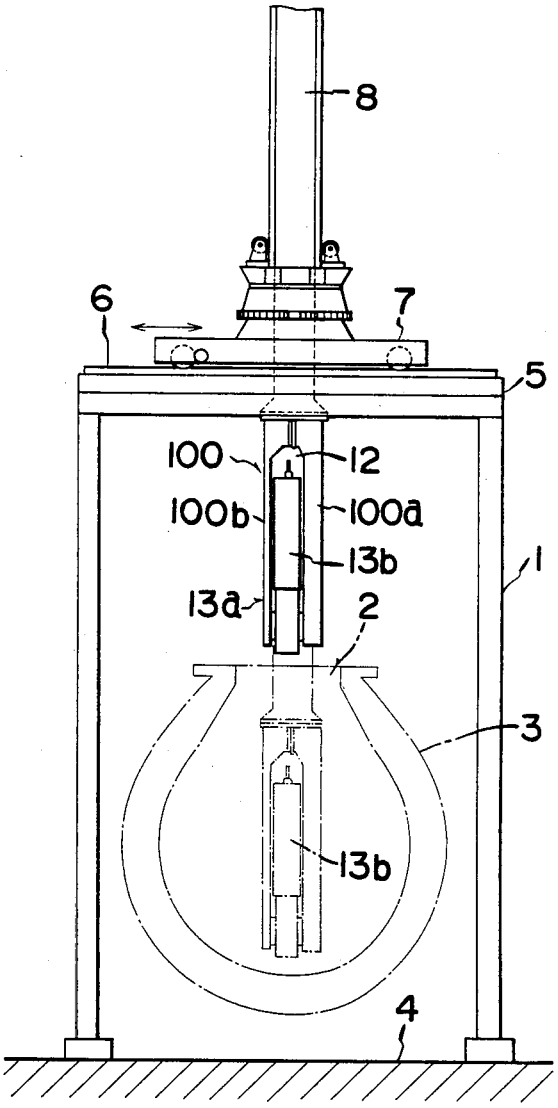
FIG. 2 is a view taken along the line I—I of FIG. 1.

FIG. 1 and FIG. 2 show the entire structure of the lining apparatus of the present invention. An overhead frame 1 is mounted on a floor 4 such that the frame 1 straddles a torpedo car 3 which has a mouth or opening on the upper face thereof. The overhead frame 1 can be of a movable type.

On an upper frame 5 of the overhead frame 1, a transport car 7 is mounted and the transport car 7 is movable in a horizontal direction along rails 6 which are perpendicular to the vertical axis of the torpedo car 3. An elevatable vertical strut 8 is mounted on the transport car 7 and passes through the transport car 7. The transport car 7 is also provided with a strut elevating device 9 and a strut rotating device 10 which elevate and rotate the vertical strut 8 respectively relative to the transport car 7. The elevatable vertical strut 8 consists of an outer shell **8*a* and an inner shell 8*b* and defines cooling water chambers 8*c* and 8*d* between outer and inner shells 8*a* and 8*b*. To the lower end of the vertical strut 8, an upper end of a bifurcated support strut 100 is fixedly connected by way of a flange 11. The bifurcated support strut 100 substantially consists of a pair of parallely extending strut elements 100*a* and 100*b* which are connected to each other at the upper portions, thus defining an arm storing space 12 between them. A pipe supporting arm 13 which encases a spray pipe 60 therein has a proximal end thereof pivotally connected to the lower end of the bifurcated vertical strut 100. Such pipe supporting arm 13, when pivoted until the axis thereof aligns with the axis of the bifurcated vertical strut 100, can be completely stored in the arm storing space 12 of the bifurcated vertical strut 100. Numeral 14 indicates a horizontal connecting member which prevents the widening the width of the arm storing space 12**.

Figure 3:
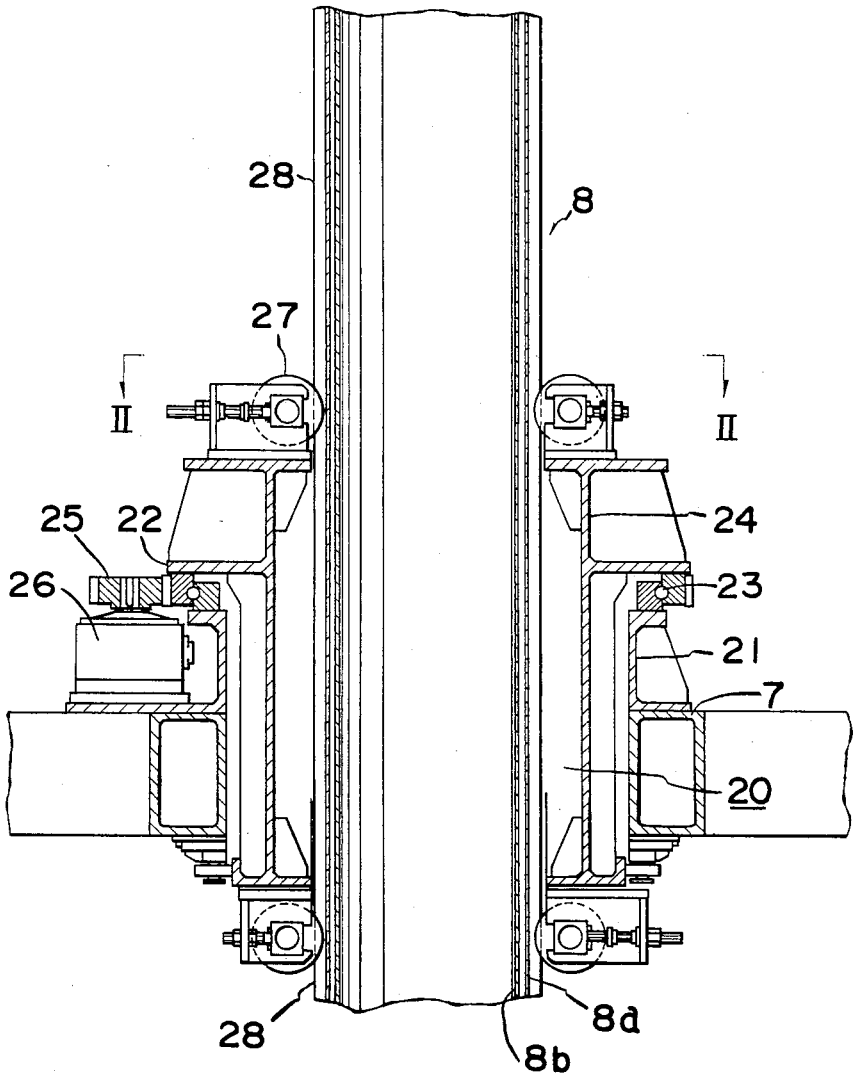
FIG. 3 is an enlarged cross-sectional view of a strut rotating device of the lining apparatus.
Figure 4:
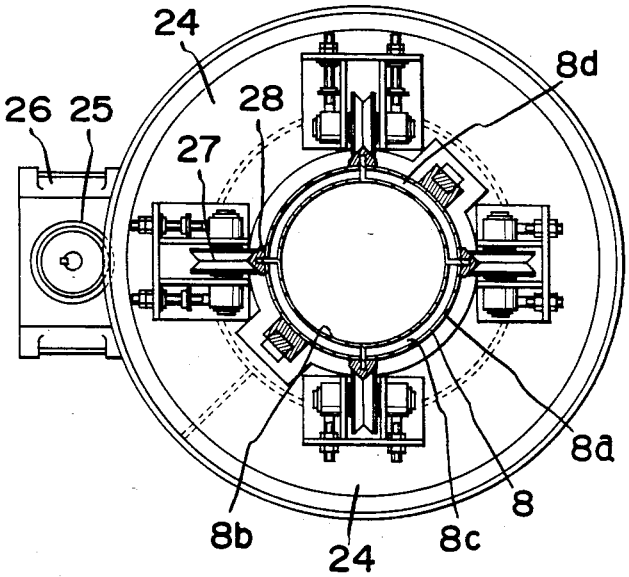
FIG. 4 is a cross sectional view taken along the line II—II of FIG. 3.
Figure 5:
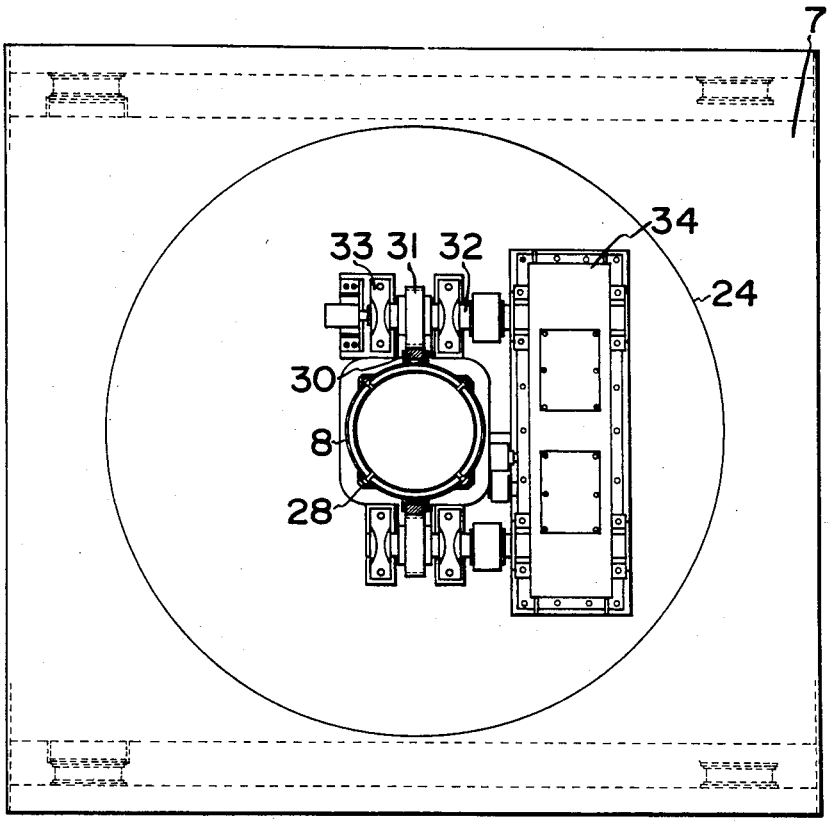
FIG. 5 is a cross sectional view taken along the line III—III of FIG. 1.

FIG. 3 to FIG. 5 show the detailed construction of the strut elevating device 9 and the strut rotating device 10. In the strut rotating device 10, numeral 20 indicates a through bore formed in the transport car 7 to allow the vertical strut 8 to pass therethrough, numeral 21 indicates a ring-like stationary seat fixedly mounted on the transport car 7 and concentrically disposed above the through bore 20, numeral 22 indicates a rotary gear rotatably mounted on the ring-like stationary seat 21 by means of a bearing 23, numeral 24 indicates a horizontal rotary body which fixedly connects the rotary gear to the bottom surface thereof, numeral 25 indicates a pinion which is fixedly mounted on an output shaft of a power-operated motor 26 mounted on the transport car 7 and engages the rotary gear 22, numeral 27 indicates guide wheels mounted on the horizontal rotary body 24 and engaging a plurality of guide ribs 28 formed on the outer peripheral surface of the elevatable vertical strut 8. Due to such construction, when the power-operated motor 26 is operated, the elevatable vertical strut 8 is rotated by way of the pinion 25, the rotary gear 22, the horizontal rotary body 24 and the guide ribs 28. Accordingly, the pipe supporting arm 13 which is connected with the vertical strut 8 by way of the bifurcated strut 100 is also rotated along with the operation of the power-operated motor.

The strut elevating device 9 is substantially mounted on the horizontal rotary body 24. In FIG. 1 to FIG. 5, numeral 30 indicates a rack formed on the outer surface of the elevatable strut 8 in a direction parallel to the axis of the elevatable vertical strut 8, numeral 31 indicates a pinion which meshes with the rack 30, numeral 32 indicates a pinion-mounting shaft on which the pinion 31 fixedly mounts and is rotatably supported by bearings 33, numeral 34 indicates a speed reduction gear box which connects the pinion-mounting shaft 32 to a power-operated motor 35. Due to such construction, when the power-operated motor 35 is operated, the elevatable vertical strut 8, the bifurcated strut 100 and the pipe supporting arm 13 are all elevated by way of the reduction gear box 34, the pinion 31 and the rack 30.

FIG. 6 to FIG. 12 show the construction of the bifurcated strut 100 and of the pipe supporting arm 13 in detail.

Figure 7:
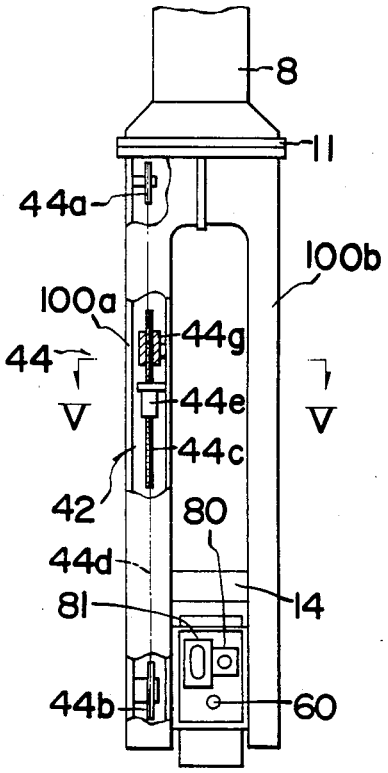
FIG. 7 is a view taken along the line IV—IV of FIG. 6.
Figure 8:
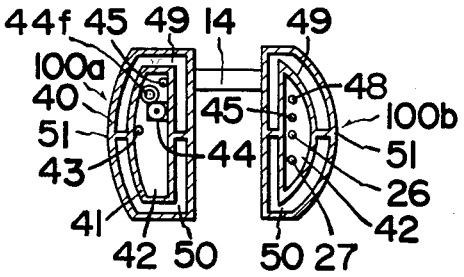
FIG. 8 is a cross sectional view taken along the line V—V of FIG. 7.

As can be seen from FIG. 7 and FIG. 8, each strut element 100*a*, 100*b* has a hemispherical hollow cross section to assure sufficient rigidity. The strut element also has a duplicate pipe construction made of an outer shell 40 and an inner shell 41. The inner shell 41 defines a protective path 42 therein in which several lines including a material supply hose are encased. That is, the inner path 42 of the strut element 100*a* contains a material supply hose 43, arm rotating device 44, and a purging air supply line 45, while the inner path 42 of the strut element 100*b* contains control lines for transmitting control signals to a pipe rotating motor 70, a pipe reciprocating motor 71 and furnace monitoring device 80, 81 and a water supply hose 47, and a purging air supply line 48.

Figure 6:
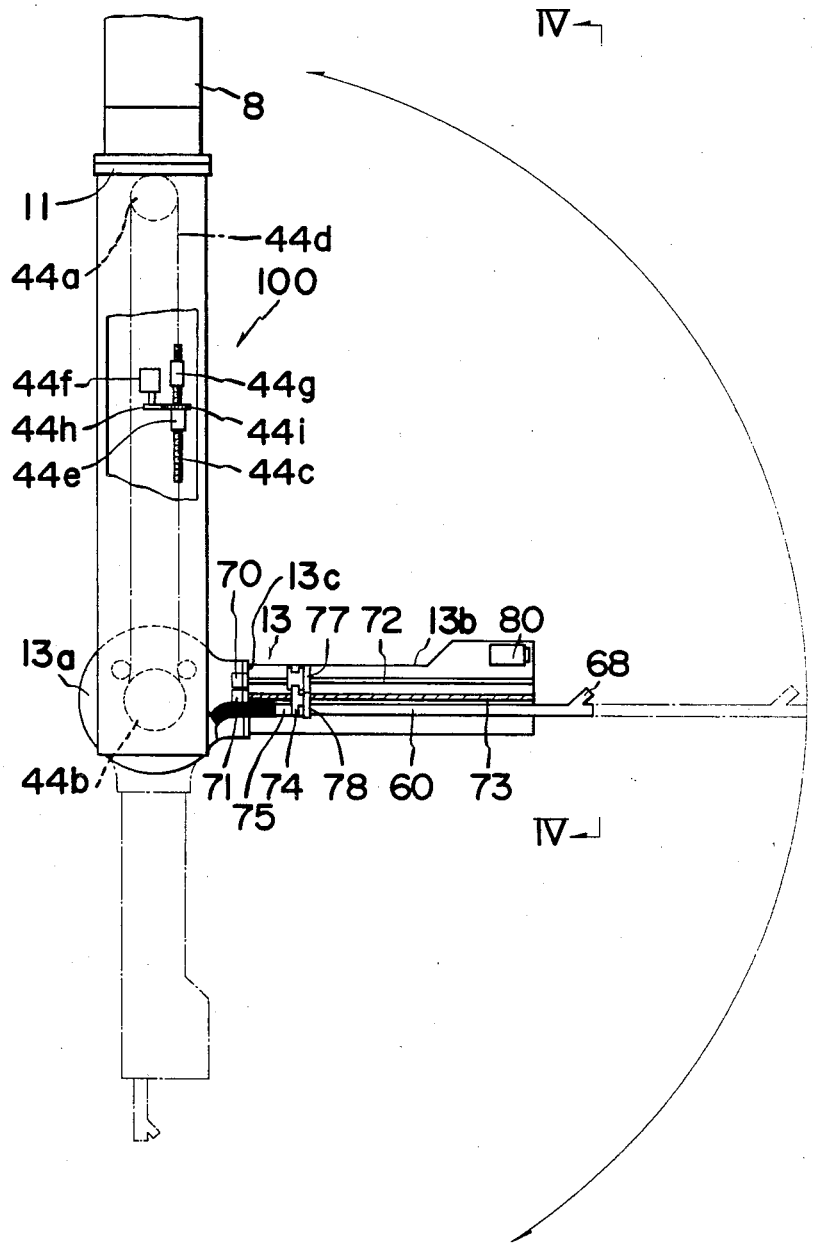
FIG. 6 is an enlarged front view of a bifurcated strut of the lining apparatus.

FIG. 6 shows an embodiment in which the arm rotating device 44 is constructed such that a pair of sprocket wheels 44*a*, 44*b* are rotatably mounted on the upper and lower ends of the strut element 100*a*, an endless chain 44*d* which has a ball screw shaft 44*c* at the midst thereof is extended between the sprocket wheels 44*a* and 44*b*, thread sleeve 44*e* is threaded to the ball screw shaft 44*c*, and the thread sleeve 44*e* is rotated by a power-operated motor 44*f* by way of a pinion 44*h* and a wheel gear 44*i*, whereby the ball thread screw 44*c* the rotation of which is restricted by a block 44*g* is moved either in an upward direction or in a downward direction thus rotating the sprocket wheel 44*b* and the pipe supporting arm 13.

In FIG. 8, the space defined between the outer shell 40 and the inner shell 41 is divided into a pair of cooling water supply paths 49 and return paths 50 which communicate with the cooling water paths 8*c*, 8*d* respectively of the elevatable vertical strut 8. Due to such construction, the lines including the material supply hose 43 are sufficiently protected from high temperature and the dust.

In FIG. 6 and FIG. 9 to FIG. 12, the construction of the pipe supporting arm 13 which encases the spray pipe 60 is shown in detail. The pipe supporting arm 13 comprises an arm joint 13*a* and an arm body 13*b*. In the arm joint 13*a*, numerals 61 and 62 indicate bearings coaxially mounted on the respective lower ends of the strut elements 100*a*, 100*b* of the bifurcated strut 100. First hollow rotary shafts 63 and 64 which are fixedly mounted on the both sides of the arm joint 13*a* are rotatably received by these bearings 61, 62. The first hollow rotary shaft 63 includes a swivel joint therein for connecting the material supply hose 43 with a extendible hose 66 wound around a hose reel drum 65, which, in turn, is rotatably mounted in the joint portion 13*a*.

Such swivel joint is constructed by rotatably mounting a pair of second hollow rotary shafts 67*a* and 67*b* and connecting these hollow rotary shafts with the material supply hose 43 and the extendible hose 66 respectively. Numeral 65*a* indicates a spring to apply winding pressure to the hose reel drum 65.

The above joint is also constructed to protect the journalling surface from dust. That is, an air injection path 61*a* is provided in the bearing 61 and such path 61*a* has one end thereof connected to the purging air supply line 45 in the strut element 100*a* and other end open at the surface of the bearing 61 to form an air outlet 61*b*. Due to such construction, the air supplied through the purging air supply line 45 can prevent dust from entering the journalling surface defined between the bearing 61 and the first hollow rotary shaft 63. Bearing 62 is constructed in a like manner to connect with the purging air supply line 45.

The arm body 13*b* has sufficient length to accommodate the elongated spray pipe which has one end thereof connected with the extendible hose 66 and other end provided with the spray nozzle 68. The arm body 13*b* is also provided with an opening 69 at one end thereof for permitting the linear movement of the spray pipe 60 relative to the arm body 13*b*.

Figure 11:
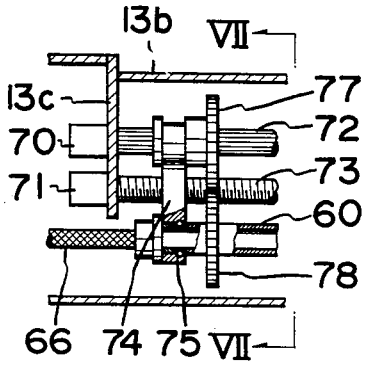
FIG. 11 is an enlarged front view of the pipe rotating device and of the pipe reciprocating device.
Figure 12:
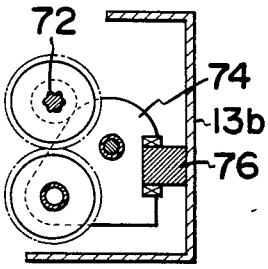
FIG. 12 is a cross sectional view taken along the line VII—VII of FIG. 11.

FIG. 11 and FIG. 12 show the construction of the pipe reciprocating device and the pipe rotating device. In the drawings, numerals 70 and 71 indicate power-operated motors for respectively rotating and reciprocating the spray pipe 60, numerals 72 and 73 indicate a spline shaft and a ball screw shaft which connect to the above motors 70, 71 respectively, numeral 74 indicates a travelling plate which has one end meshed with the ball screw shaft 73 and the other end connected to the spray pipe 60 by way of a swivel joint 75 and is moved along a guide rail 76 with the rotation of the ball screw shaft 73, numeral 77 indicates a drive-side gear which is mounted on the spline shaft 72 and has the midst portion thereof engaged with the travelling plate 74, and numeral 78 indicates a driven-side gear which is fixedly mounted on the spray pipe 60 and engages the drive-side gear 77.

Due to such construction, when the power-operated motor 71 is operated, the spray pipe 60 is moved linearly by way of the ball screw shaft 73 and the swivel joint 75 of the travelling plate 74, while when the power-operated motor 70 is operated, the spray pipe 60 is rotated by way of the spline shaft 72, the drive-side gear 77 and the driven-side gear 78.

The arm body 13*b* is also provided with a furnace monitoring device such as a camera 80 and a lighting device 81 at the extremity thereof.

Figure 9:
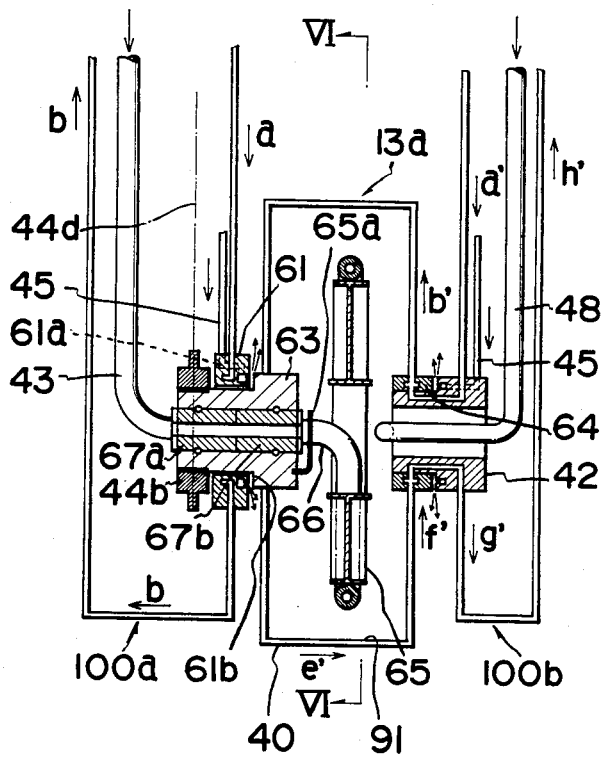
FIG. 9 is an enlarged front view of the arm joint of the lining apparatus.
Figure 10:
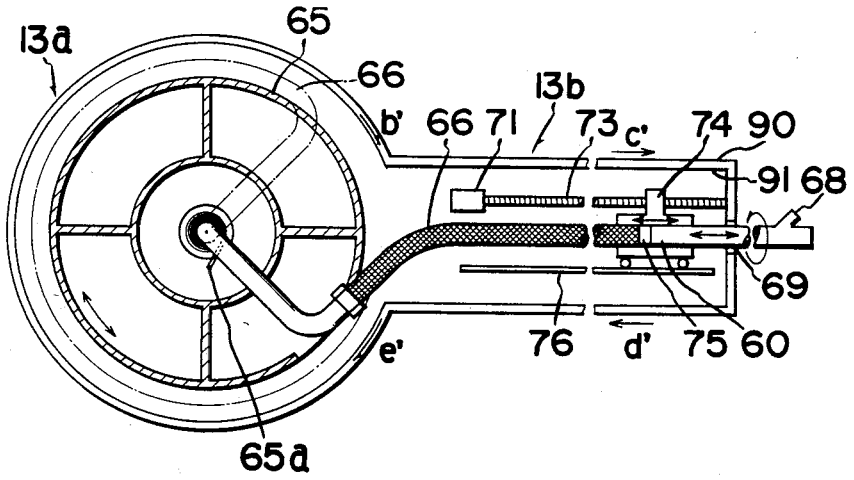
FIG. 10 is a cross sectional view taken along the line VI—VI of FIG. 9.

Additionally, the pipe supporting arm 13 is provided with a water jacket construction as in the case of the bifurcated strut 100. As shown in FIG. 9 and FIG. 10, the pipe supporting arm 13 has a duplicate pipe construction made of an outer shell 90 and an inner shell 91 defining a pair of cooling water paths. These paths communicate with the cooling water paths defined in the strut elements 100*a* and 100*b* respectively. In the drawings, arrows a, b and arrows a' to h' indicate the direction of the water flow in the strut elements 100*a*, 100*b* and the pipe support arm 13. Numeral 45 indicates a cooling air path leading to the bearing 61.

The manner in which the lining operation is conducted with the lining apparatus of the above construction is hereinafter disclosed.

The transport car 7 is moved into position as shown in FIG. 1 in a solid line so that the elevatable strut 8 and the bifurcated strut 100 are disposed directly above the opening 2 of the torpedo car 3. At this stage of operation, the pipe supporting arm 13 is stored in the arm storing space 12 of the bifurcated arm 13. A cooling water supply device and an air supply device (not shown in the drawings) are operated so as to supply cooling air to the elevatable strut 8 and the bifurcated strut 100 to cool these elements and purging air to the pipe supporting arm 13. The strut elevating device 9 is operated to lower the bifurcated strut 100 along with the elevatable strut 8 until they take the position inside torpedo car 3 as shown by the dotted lines. The arm rotating drive device 44 disposed in the strut element 100*a* is operated to make the pipe supporting arm rotate about 90 degrees and take the extended position shown by the dotted lines. The pipe reciprocating device is operated to extend the spray pipe 60 from the pipe supporting arm 13. If desired, the pipe rotating device is also operated so as to rotate the spray pipe 60 and accurately direct the spray nozzle to an eroded portion of the torpedo car 3. The refractory material supply device (not shown in the drawings) is operated to apply the refractory material onto the eroded portion by way of the material supply hose 43, the extendible hose 66, the spray pipe 60 and the spray nozzle 68.

In the above lining operation, since the bifurcated strut 100 and the pipe supporting arm 13 are sufficiently water-cooled and the bifurcated strut 100 defines completely closed protective paths, all the necessary lines including the material supply hose 43 and various control lines are sufficiently protected from the temperature and dust. Furthermore, the air supplied to the inside of the pipe supporting arm 13 can prevent dust from adhering to the furnace monitoring device thus assuring a clear visual field for the monitoring device.

As has been described heretofore, the lining apparatus of the present invention can efficiently conduct the lining operation of the torpedo car even in an adverse environment of high temperature and extreme dust.

What we claim is:

1. A lining apparatus provided with a foldable spray pipe comprising an elevatable vertical support strut supported by a frame, a bifurcated support strut having an upper end thereof connected to the lower end of said elevatable vertical support strut, said bifurcated strut comprising a pair of parallely extending strut elements which define an arm storing space therebetween opening at both sides, a pipe supporting arm foldably connected to the lower end of said bifurcated strut and encasing a spray pipe therein and a protective path formed in each strut element of said bifurcated strut allowing a plurality of lines including a material supply line to pass therethrough, and said apparatus is further provided with an arm joint which comprises (a) bearings fixedly mounted on the inner sides of said lower end of said strut elements, (b) rotary shafts mountedon corresponding sides of the proximal end of said pipe supporting arm and rotatably received in said bearings thus forming a joint portion, and (c) at least one air purging path formed in said joint portion for injection air to at least one end of a joint surface.

2. A lining apparatus provided with a foldable spray pipe according to claim 1, wherein an arm joint is formed by mounting a bearing in the lower end of one said strut element of said bifurcated strut and rotatably supporting a first hollow rotary shaft mounted on a corresponding end of said pipe supporting arm, a hose reel drum concentric with said first hollow rotary shaft rotatably encased in said arm joint and an extendible hose wound around said hose reel drum with one end of said hose connected to said material supply hose extending in said strut element and other end connected to a proximal end of said spray pipe disposed in said pipe supporting arm.

3. A lining apparatus provided with a foldable spray pipe according to claim 1, wherein said pipe support arm is provided with a furnace monitoring device in the front extremity thereof.

* * * * *